US005145028A

United States Patent [19]

Wu

[11] Patent Number: 5,145,028

[45] Date of Patent: Sep. 8, 1992

[54] LIFE-SAVING DEVICE FOR PEOPLE IN TALL BUILDINGS

[76] Inventor: Chin-Hua Wu, 4F, No. 7, Alley 28, Hsin-Chien Lane, Chung-Cheng Rd, Hsin-Chuan City, Taipei Hsien, Taiwan

[21] Appl. No.: 801,370

[22] Filed: Dec. 2, 1991

[51] Int. Cl.[5] ..... A62B 1/00

[52] U.S. Cl. ..... 182/5; 188/65.5; 182/193

[58] Field of Search ..... 182/5, 6, 7, 8, 9, 190, 182/191, 192, 193, 241; 188/65.1, 65.2, 65.3, 65.4

[56] References Cited

U.S. PATENT DOCUMENTS 573,139 12/1896 Wethered ..... 182/241 X
1,241,701 10/1917 Bencur ..... 182/6 X
4,145,027 3/1979 Brimo ..... 182/193
4,223,761 9/1980 Sonnberger ..... 182/5
4,494,629 1/1985 Raeburn ..... 188/65.2 X
4,645,034 2/1987 Griffith ..... 182/5 X
4,662,475 5/1987 Rütschi et al. ..... 182/192 X

*Primary Examiner*—Karen J. Chotkowski
*Attorney, Agent, or Firm*—Pollock, Vande Sande & Priddy

[57] ABSTRACT

A life-saving device includes a reel wound with rope or steel wire accommodated within a housing which has a lower portion for supporting the user. The housing has a plurality of connecting rods which, when their position is changed, can alter the pressure exerted by a number of pressure rollers on the rope, so that the rope is drawn out and hence the resistance against the housing is changed. The housing further comprises a pair of handles whereby the ropes can be checked if desired.

3 Claims, 2 Drawing Sheets

LIFE-SAVING DEVICE FOR PEOPLE IN TALL BUILDINGS

Field of the Invention

The present invention relates to a safety system, and particularly an improved life-saving device suitable for people in tall buildings in case of accidents.

BACKGROUND OF THE INVENTION

The rather high casulties relating to accidents in tall buildings have encouraged inventions in the direction of safety systems for high rise buildings, and most of these inventions relate to life parachutes. However, because almost all disasters in tall buildings are caused by fire burning from the lower floors to the upper floors, the use of life parachutes in rescuing people trapped may not be effective due to strong wind or fire, rugged ground surface, or the user's improper use of the parachute or fear of jumping down.

There is also a kind of safety equipment which makes use of cable cars pulled by chains. These cars are ordinarily fixed to the balcony of each floor, and in case of fire, these cars can be descended to the groung manually or by means of motor. However, these cars are very bulky, and in practice, fixing them to the balconies is really a problem.

Prior art also teaches a portable life-saving device which comprises a housing, rollers wound with steel wire accommodated therewithin, a braking means consisting a pair of brakes, and a pair of handles provided on both sides of the housing. One end of the steel wire is secured to a firm object, and the wire is caused to pass through the braking means whereby the user may descend to the ground. The user may manipulate the brakes each disposed at the front end of the handles to grip the wire so as to slide along or halt. However, this prior art overlooks the fact that both the brakes and the wire are made of steel. When the brakes and the wire press against each other, as a result of their steel property, the wire will either become locked or slide along unimpeded, especially when the wire bears the weight of a heavy person, say, a man of 100 kg. In this case, the brakes may either lock the wire or allow the wire to slide along unobstructed. The result of the above-mentioned setback is that when the user is falling down from a high position, he or she may be unable to brake the falling motion and may crash to the ground, or the user may, in panic, grip the handles too hard that the wire is locked to stop further descent; but when the user releases the grip and turns the handles, he or she may fall swiftly down. In this case, the user may suffer from sudden halts and sudden fast descent. Therefore, even though this prior art provides a braking system, in practice, the user may not control the sliding speed at will. Such a drawback has rendered the above-mentioned invention of little use in rescuing people trapped in tall buildings.

SUMMARY OF THE INVENTION

The primary object of the present invention provides a light and safe device which is easily operated and the sliding speeding thereof may be practically controlled. The user just hooks the safety hook provided at the upper end of the device to any firm object, for example, iron balustrade, puts on the supporting means provided at the lower portion of the device, and holds the two handles at the sides of the device to maneuver the descent. By this simple operation, the user may slide down at the speed desired.

BRIEF DESCRIPTION OF THE DRAWINGS

The foregoing and other features and advantages of the present invention will be more clearly understood from the following detailed description and the accompanying drawings, in which.

Detailed Description of the Preferred Embodiments

Figure 1:
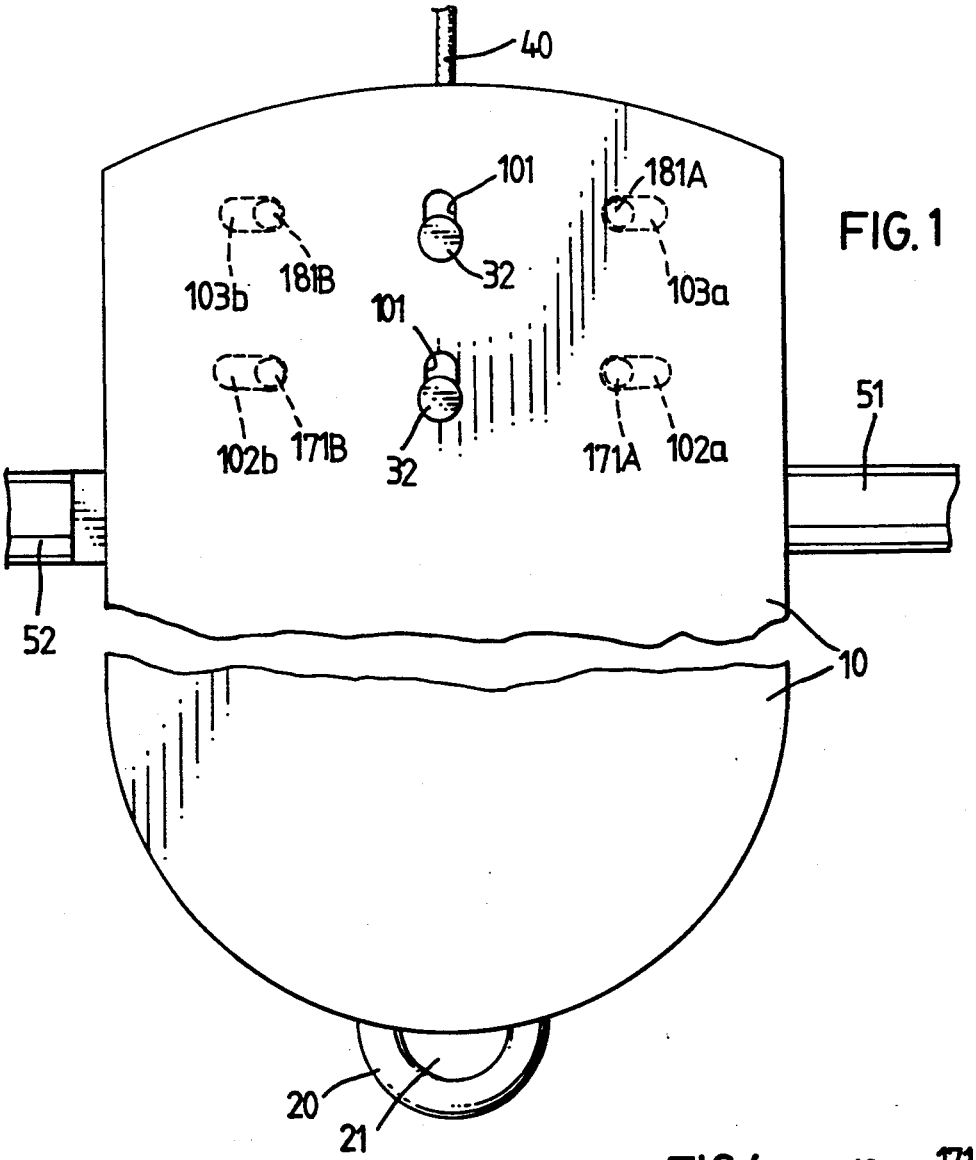
FIG. 1 is an elevational view of an embodiment of the present invention.

As shown in the drawings, the present invention comprises a housing 10, and a hooking means 20 provided at the lower portion thereof. Preferably, the hooking means 20 is a ring 21 for connecting with a supporting means such as a safety belt, safety net, or the like. The ring 21 may be connected to such a supporting means in advance or in actual use. Or the hooking means 20 may be an integral part of the housing 10. The specific techniques in relation therewith are not discussed herein since they are considered irrelevant to the present invention.

Figure 3:
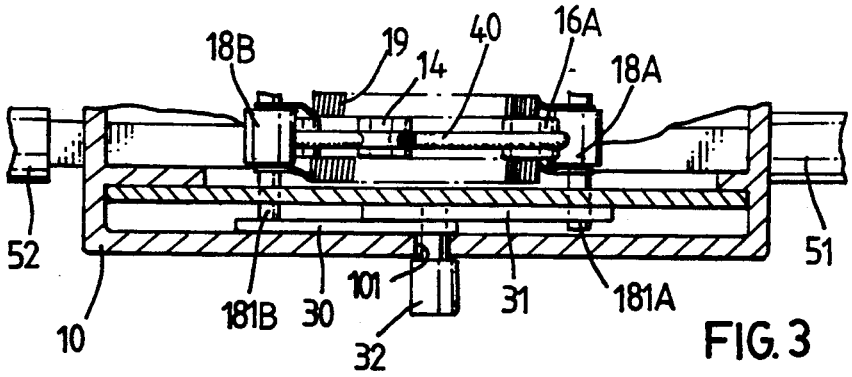
FIG. 3 is a sectional view taken along line 3—3 of FIG. 2.

The housing 10 has pivotally disposed therewithin a reel 11 of rope, such as steel wire 40, and the upper periphery of the reel 11 is pivotally provided with a first roller 12. The upper portion of the housing 10 has a hole 13 for the steel wire 40 to pass through. At the periphery of the hole 13, a second roller 14 is provided. Between the first roller 12 and the second roller 14, there are a plurality of intermediate rollers. In the drawings, two pairs of intermediate rollers 15A, 15B, and 16A, 16B are illustrated. The wire 40 wound round the intermediate rollers 15A, 15B, and 16A, 16B, and the angle A it forms with each of the intermediate rollers in contact is at least greater than 90 degrees. As a general rule, the greater the angle A, the better the effect of the deceleration system of the present invention (to be described hereinafter). Preferably, the angle is about 180 degrees. As shown in FIG. 3, the wire 40 winding round two intermediate rollers forms an S-shape track. A continuous S-shape track may be formed if more intermediate rollers are provided.

A further characteristic of the present invention is that the housing 10 is provided with a plurality of slots for the sliding movement of pressure rollers. In the drawings, two pairs of slots **102*a*, 102*b*, and 103*a*, 103*b*, and two pairs of pressure rollers 17A, 17B, and 18A, 18B are illustrated. The slots are arranged near to the intermediate rollers, and each pair of slots has accommodated therein a pair of pressure rollers. Preferably, each pair of intermediate rollers has a corresponding pair of pressure rollers. For instance, as shown in FIG. 3, the first pair of intermediate rollers 15A, 15B are next to the first pair of pressure rollers 17A, 17B, and the second pair of intermediate rollers 16A, 16B are next to the second pair of pressure rollers 18A, 18B. With reference to FIG. 3, each pair of pressure rollers are connected by a tension rod 19 with two ends 191, 192, which are respectively fixed to the shaft 171***a*, (181*a*) of pressure roller 17A (18A), shaft 171*b* (181*b*) of pressure roller 17B (18B). Generally speaking, the tension rods 19 may be extension springs or a hydraulic cylinders. The purpose of the tension rods 19 is to urge each pressure roller against its adjacent wire 40 under a normal circumstance, so that the sliding speed of the wire 40 may be decelerated.

Figure 4:
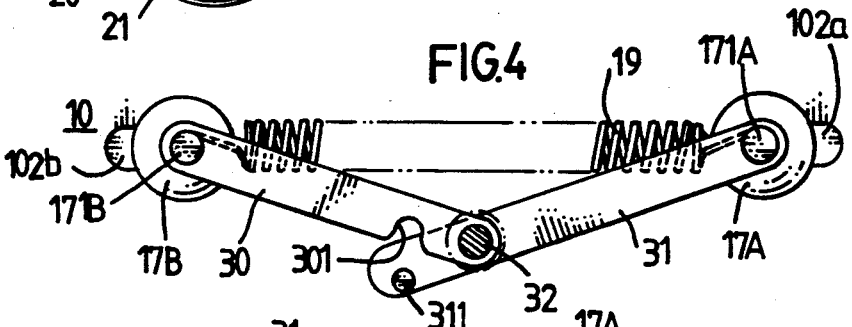
FIG. 4 illustrates the deceleration mechanism of the present invention.
Figure 5:
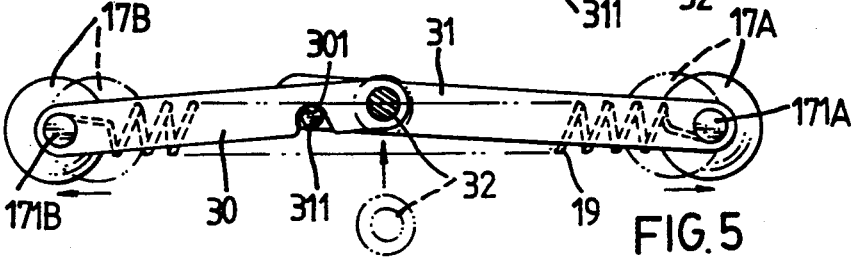
FIG. 5 illustrates the acceleration mechanism of the present invention.
Figure 2:
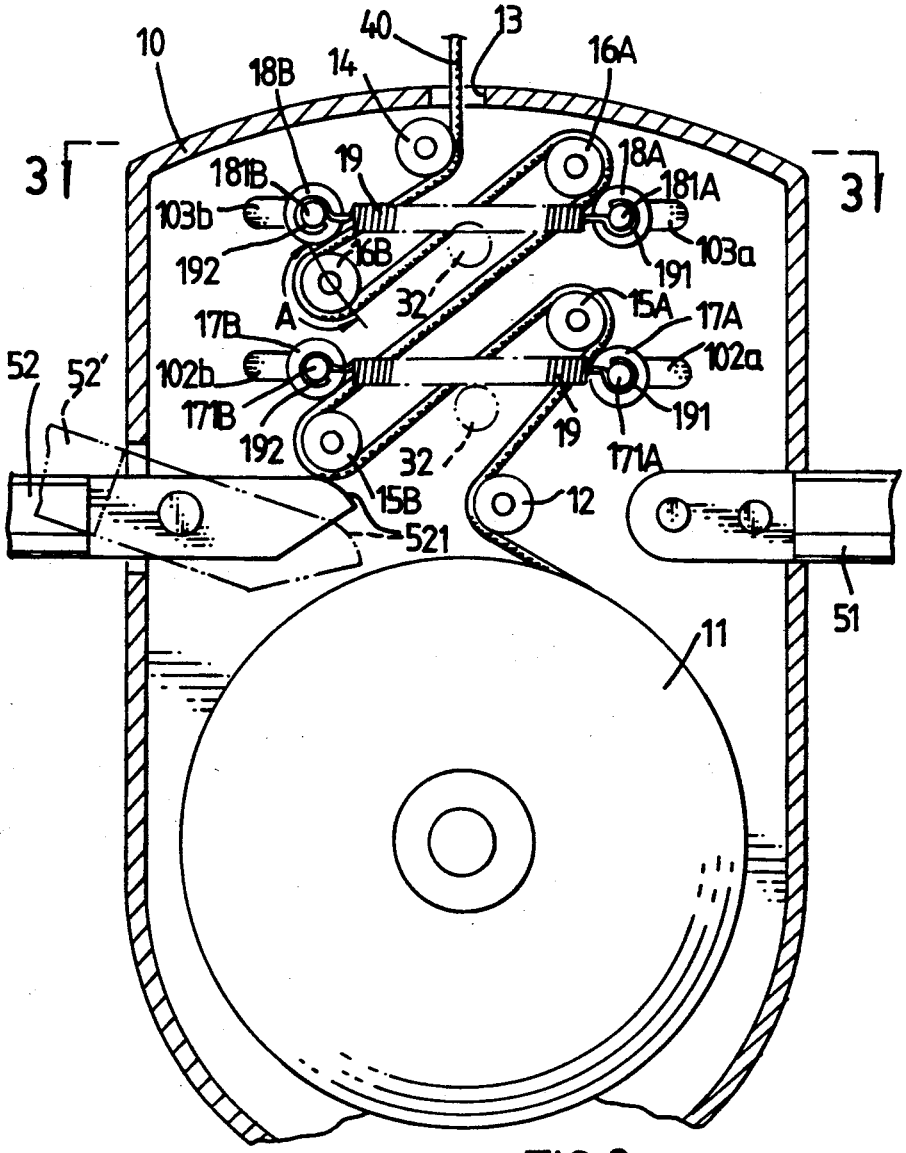
FIG. 2 is a sectional view of the embodiment of the present invention.

As shown in FIGS. 4, 5, and 6, the shafts of each pair of pressure rollers are respectively pivotally connected to the first ends of two connecting rods 30, 31. The second ends of the connecting rods are pivotally joined together by means of a push rod 32 which passes from the housing 10 through a slot 101 (see FIG. 2) along which the push rod 32 moves. The first connecting rod 30 has provided therein a recess 301; the second connecting rod 31 has a pin 311 corresponding to the recess 301. Apparently, for two horizontally disposed slots, such as 102*a* and 102*b*, or 103*a* and 103*b*, there is a slot arranged substantially perpendicular thereto to serve as a track or passage for the push rod 32.

With reference to FIGS. 4 and 5, when the user pushes the above-mentioned push rod 32 upward from the position shown in FIG. 4 to the position shown in FIG. 5, the connecting rods 30 and 31 may push the shafts 171*a*, 171*b* of pressure rollers 17A, 17B to move along slots 102*a*, 102*b* so that the pressure rollers 17A and 17B disengage from the steel wire 40. When the frictional resistance against the steel wire 40 is decreased, the descending speed of the user increases. When the user releases a pair of pressure rollers, the descending speed will further increase. When the pin 311 of the connecting rod 31 is inserted into the recess 301 of the connecting rod 30, the connecting rods 30, 31, will remain stretched as shown in FIG. 5.

When deceleration is desired, the push rod 32 is caused to move downward from the position in FIG. 5. to the position in FIG. 4, and the above-mentioned tension rod 19 automatically causes the pressure rollers 17A, 17B to draw together to press against steel wire 40 so as to decelerate the descending speed.

A fixed handle 51 is provided on the right side of the housing 10, and a movable handle 52 whose inner rim 521 forms a braking means is pivotally provided on the other side thereof. When the movable handle 52 is pressed downward to the position of 52' in FIG. 2, the inner rim 521 approaches any one of the rollers in the housing 10, such as roller 15B, so that the roller 15B presses against steel wire 40 to check the movement thereof. Although either the braking means or any of the rollers can stop the steel wire's movement, there is a distinctively difference in their performance. Because rollers are round, they cannot completely check the steel wire, but the braking means is not round and can therefore completely check the steel wire if necessary.

In view of the aforesaid, the present invention offers an improved life-saving device the descending speed of which is adjustable so that the user can control the descending speed at will and may, if necessary, stop the descent, effectively preventing the user from getting hurt in panic.

Although the present invention has been illustrated and described with reference to the preferred embodiments thereof, it should be understood that it is in no way limited to the details of such embodiments, but is capable of numerous modifications within the scope of the appended claims.

What is claimed is:

1. An improved life-saving device for people in tall buildings, said device comprising:

a housing having plural pairs of first slots and a plurality of second slots, such that each of said second slots is perpendicular to each pair of said frist slot, a hooking means provided at the lower portion thereof for supporting a human body, and a hole in the upper portion thereof;

a reel of rope accommodated within said housing, said rope extending from said hole in said housing;

a first roller provided at the periphery of said reel, and a second roller pivotally provided near said hole of said housing;

plural pairs of intermediate rollers provided between said first roller and said second roller, said rope winding round said first roller and around said intermediate rollers to form an angle at least greater than 90 degrees with each of said intermediate rollers in contact, such that said rope forms a continuous S-shape track in the space between said first roller and said second roller;

at least one pair of movable pressure rollers capable of being drawn together provided near a pair of said intermediate rollers; said movable pressure rollers being connected by a tension rod disposed therebetween and pivotally provided in one of said first slots, so that each pressure roller is caused to press against its adjacent rope a pair of connecting rods, the first end of each connecting rod being pivotally coupled to a shaft of one of said pressure rollers, the second end of both connecting rods being commonly pivotally connected to a push rod, wherein when said push rod moves along said one of second slots, said pair of connecting rods are caused to move along one of said first slots.

2. A device as claimed in claim 1, wherein said housing comprises a fixed handle and a movable handle, said movable handle being pivotally provided on said housing and the inner rim of said movable forming a braking means, said movable handle being capable of moving close to anyone of said rollers accommodated within said housing and pressing against the rope on said roller.

3. A device as claimed in claim 1, wherein said tension rod is an extension spring, and said rope is steel wire.

* * * * *